United States Patent [19]

Dubois et al.

[11] Patent Number: 4,982,867

[45] Date of Patent: Jan. 8, 1991

[54] DRUM WITH SELF-SUPPORTING LINER

[75] Inventors: Robert A. Dubois, Marion, Ohio; Richard A. Caron, Long Meadow, Mass.

[73] Assignee: Greif Brothers Corporation, Delaware, Ohio

[21] Appl. No.: 487,529

[22] Filed: Mar. 2, 1990

Related U.S. Application Data

[63] Continuation-in-part of Ser. No. 458,249, Dec. 28, 1989, which is a continuation-in-part of Ser. No. 304,965, Jan. 30, 1989, abandoned.

[51] Int. Cl.[5] ..... B65D 25/16

[52] U.S. Cl. ..... 220/403; 220/408; 220/410

[58] Field of Search ..... 220/403, 408, 410

[56] References Cited

U.S. PATENT DOCUMENTS

| | | | |
|---|---|---|---|
| 4,122,973 | 10/1978 | Ahern | 220/410 |
| 4,335,074 | 6/1982 | Bernas | 220/410 |
| 4,379,455 | 4/1983 | Deaton | 220/410 |
| 4,439,177 | 3/1984 | Conway | 220/410 |
| 4,756,445 | 7/1988 | Aergg, Sr. | 220/408 |

*Primary Examiner*—Joseph Man-Fu Moy

*Attorney, Agent, or Firm*—Kane, Dalsimer, Sullivan, Kurucz, Levy, Eisele and Richard

[57] ABSTRACT

A two-part drum includes a blow molded self supporting plastic liner with circumferential reinforcing grooves, and a shell. The shell and the liner have matching cross-sections defined by curved sidewalls and curved sections cooperating to form a nominally rectangular or square cross-section.

15 Claims, 5 Drawing Sheets

DRUM WITH SELF-SUPPORTING LINER

RELATED APPLICATIONS

This application is a continuation-in-part of application Ser. No. 458,249 filed on Dec. 28, 1989 and entitled A CONTAINER FOR FLUID OR GRANULAR MATERIALS which is a continuation-in-part of application Ser. No. 304,965 filed Jan. 30, 1989, now abandoned.

BACKGROUND OF THE INVENTION a. Field of Invention

This invention pertains to a drum made of several components and having a unique cross-sectional shape, and more particularly to a drum having generally square or rectangular cross sectional shape with rounded corners and including a self supporting plastic liner surrounded by a corrugated fiber shell.

b. Background of the Invention

Various goods, including liquids, dry or powdery materials, or semi-liquid goods are preferably shipped and stored in drums. Preferably these drums must be light weight so that they reduce the overall shipping weight and costs, and so that they can be manipulated easily when they are empty. Another criteria considered in making the drums is that they should have a shape which is space efficient so that a large number of drums can be stored efficiently in a small amount of space either during shipping or storage. Over the years drums having various shapes have been tried in the industry. For example cylindrical drums have been tried which are strong structurally but are not space-efficient because when several such drums are disposed side by side, there is a considerable amount of space left therebetween. Square or rectangular containers are much more space efficient since they can be disposed side-by side with virtually no dead space therebetween. However structurally they are not as strong as cylindrical drums, and furthermore such containers present sharp vertical edges which are particularly prone to crushing and even rupture.

Additionally, it was found that it is advantageous to make a drum made of two components: a plastic inner lining disposed in a fiber shell. However the shell must be usually made strong enough to support the inner lining and therefore it is usually bulky and must include various lining reinforcing means.

OBJECTIVES AND SUMMARY OF THE INVENTION

In view of the above-mentioned problems and disadvantages of the prior art, it is an objective of the present invention to provide a drum or container having a unique crosssectional shape which is structurally stronger than a square or rectangular container, yet more space efficient than a cylindrical drum.

A further objective is to provide a composite drum with a self-supporting inner liner whereby the shell surrounding said liner can be made thinner.

Other objectives and advantages of the present invention shall become apparent form the following description of the invention. Briefly a drum constructed in accordance with this invention consists of a plurality of sidewalls each of said sidewalls being curved with respect to an axis parallel to a longitudinal (or vertical axis) of the drum. The sidewalls are interconnected by an equal number of corner sections, said corner sections having a radius of curvature much smaller than the radius of said sidewalls. The drum consists of blow-molded inner liner provided with a plurality of vertically spaced circumferential grooves. These grooves are arranged and constructed to reinforce the liner to make it self-supporting. A fiber shell surrounds the inner liner.

DETAILED DESCRIPTION OF THE INVENTION

Figure 1:
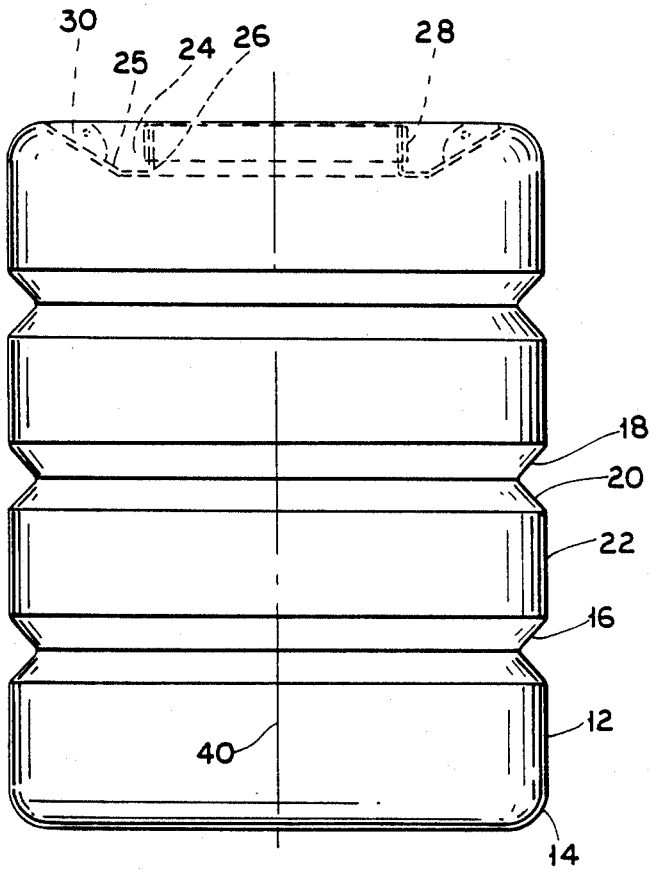
FIG. 1 shows a side view of a liner for a drum constructed in accordance with this invention.
Figure 2:
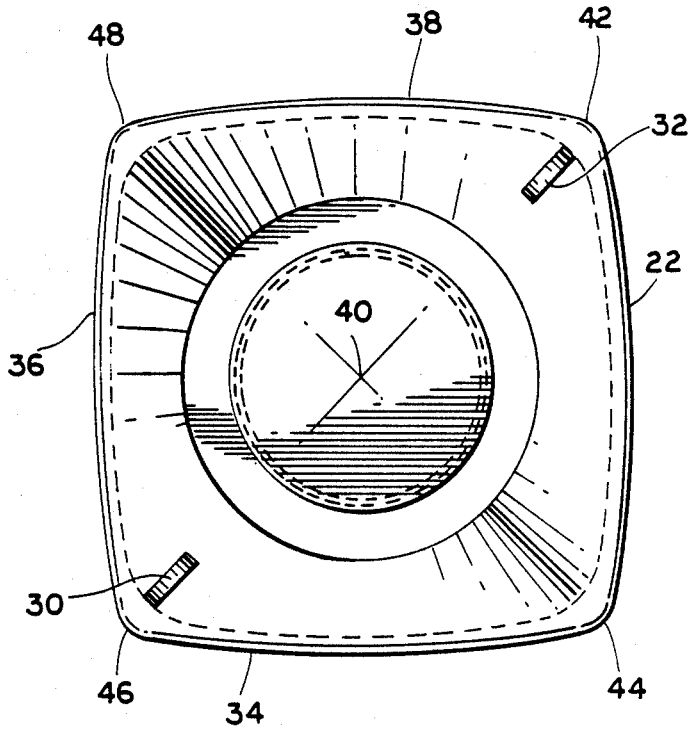
FIG. 2 shows a top view of the liner of FIG. 1.

Referring now to the drawings, a drum 10 constructed in accordance with this invention is provided wit a plastic blow molded liner 12 shown in detail in FIGS. 1 and 2. The liner is made for example of low density polyethylene and is typically about 0.040" thick. The liner is rounded at the top and the bottom as at 14, and is provided with a plurality of circumferential grooves 16 ( three such grooves being shown in FIG. 1). Preferably each groove is V-shaped and is formed by two edge walls 18, 20 disposed at an angle of 45 with respect to sidewall 22 as shown. The grooves are arranged and constructed to reinforce the liner thereby making self-supporting so that no reinforcing structure is required to support it even when it is filled up with a material. The size of the groove is determined by the overall dimensions of the liner. For example a nominal 55 gallon drum liner may be made which has the outermost dimensions of about 37"H×19.625"W×19.625"D. For this type of liner, the grooves 16 may be typically about 1" deep. In the embodiment of FIGS. 1 and 2 the liner 12 is provided with a recess 24 on its top surface 25. Within this recess 24 there is provided a centrally disposed circular neck 26 with a liner cover 28 fitted or screwed over the neck 26. The neck 26 and the cover 28 are sized and shaped so that the cover does not protrude beyond the top of the liner 12 as shown. Also within this recess 24, the liner is provided with a pair of ears 30, 32 provided so that the liner can be lifted up if necessary.

As shown more clearly in FIG. 2, the drum liner has a very specific cross-sectional shape. More specifically while the liner has a nominal square cross section, it actually has four sidewalls 22, 34, 36, and 38, each sidewall being curved along an axis which is parallel to the longitudinal or vertical axis 40 of liner 12. Preferably the sidewalls 22, 34, 36, 38 have a relatively large radius of curvature when compared with the nominal cross-sectional dimensions of the liner. For example for a liner having a nominal cross section of 19.625"×19.625" the radius of curvature of the sidewalls is about 60". The four sidewalls 24, 34, 36, 38 are interconnected by four corner sections 42, 44, 46 and 48 which have a much smaller radius of curvature then the sidewalls, such as for example about 1.25". The resulting shape is advantageous because structurally it approaches the strength of a cylindrically shaped liner and cooperates with the grooves 16 to make the liner self-supporting. However because of the large radius of curvature of the sidewalls, several drums of this shape may be disposed adjacent to each other with very little dead space therebetween.

Figure 3:
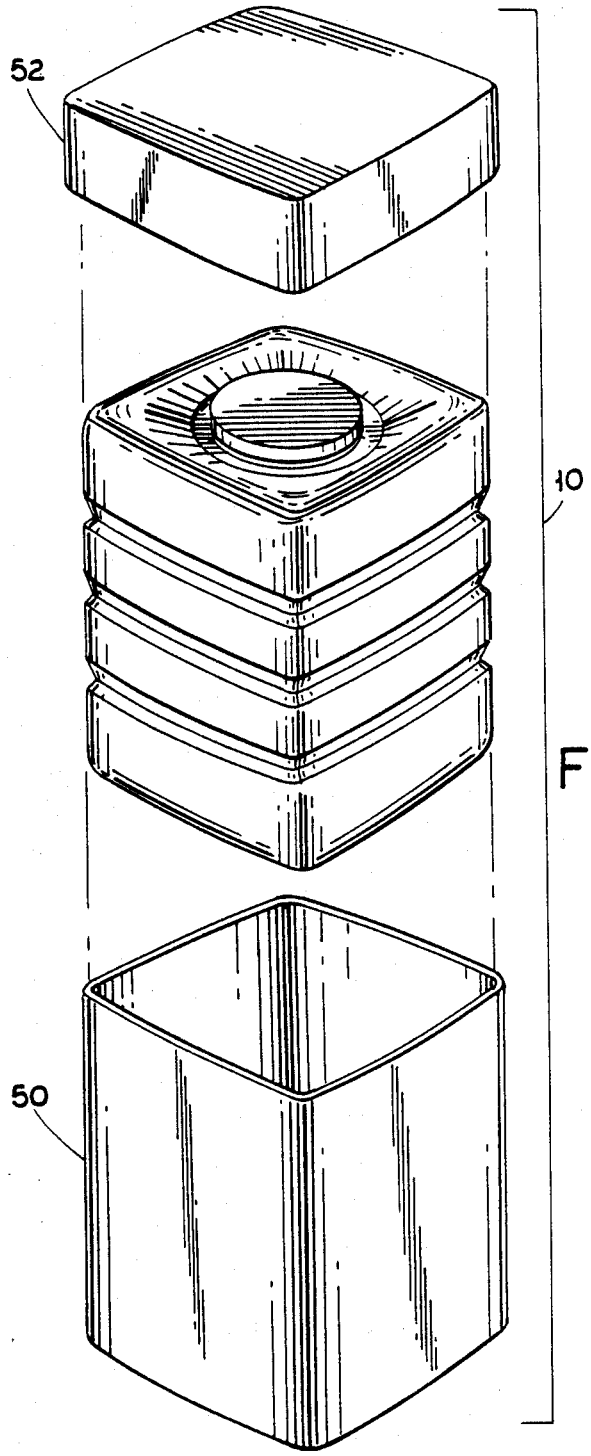
FIG. 3 shows an exploded view of the complete drum with the liner of FIGS. 1 and 2.

As seen more clearly in FIG. 3, drum 10 also includes a shell formed of a body section 50 substantially coextensive with the liner 12, and a top section 52 which mat be fitted telescopically over the body section thereby closing the drum. The body section 50 and the top section 52 have body sidewalls and top sidewalls as well as body corner sections and top corner sections respectively to form the same cross-sectional shape as the liner shown in FIG. 2. The body section is sized so that the liner fits snugly within the body section 50. The top section 52 in turn fits snugly over the body section. Preferably the shell formed by sections 50 and 52 is made of a single or multi-ply fiber such as paper or cardboard. If necessary, the top section 52 may be secured to the body section by a circumferential adhesive tape (not shown).

Figure 4:
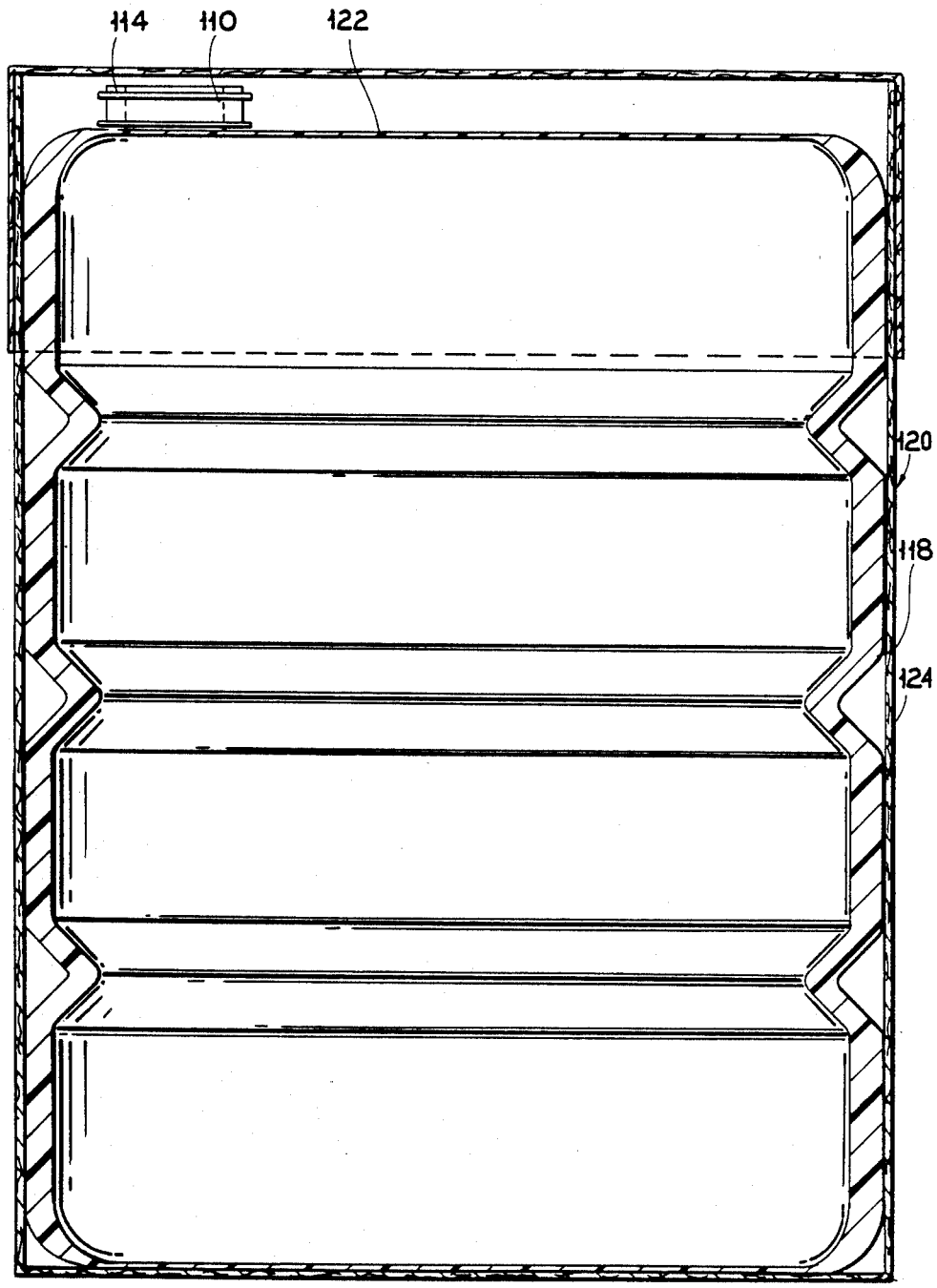
FIG. 4 shows a side-sectional view of an alternate embodiment of the invention.
Figure 5:
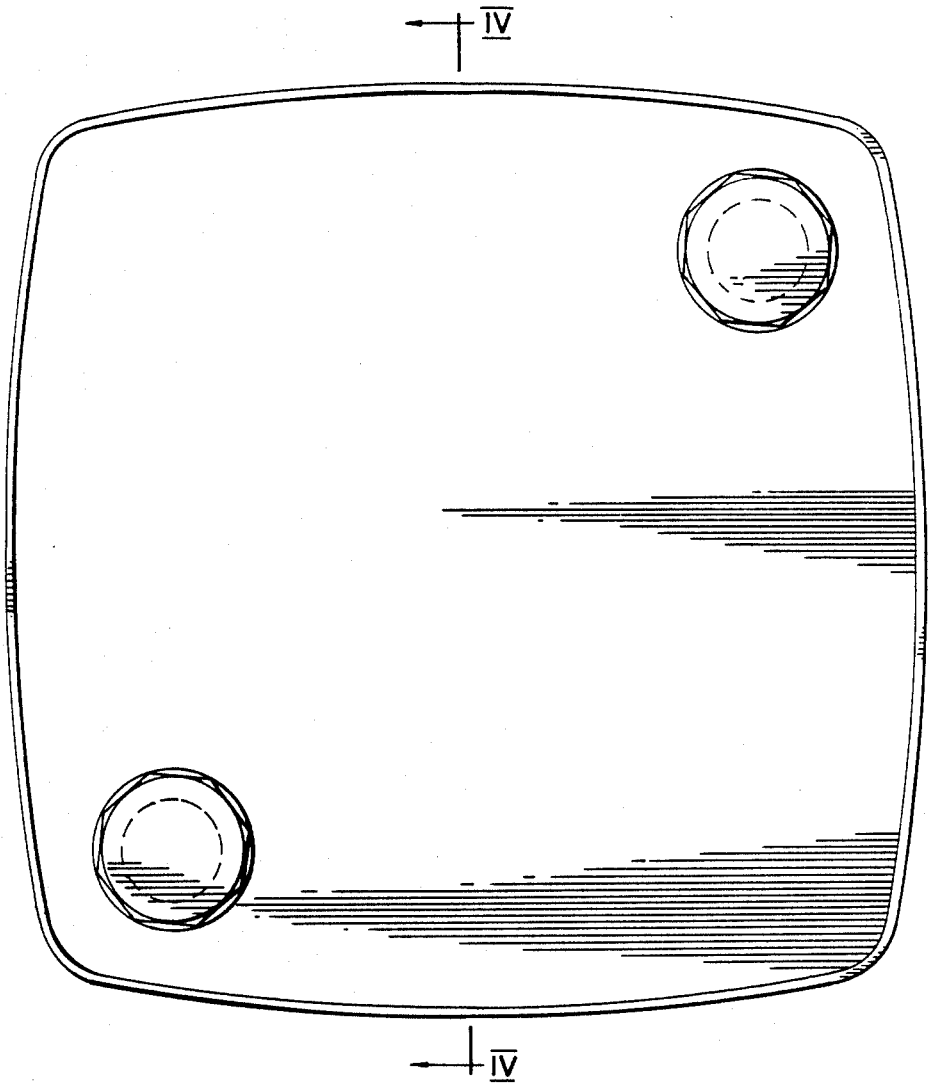
FIG. 5 shows a top view of the embodiment of FIG. 4.

An alternate embodiment of the invention is shown in FIGS. 4 and 5. As shown in these Figures, in this embodiment, instead of a single, relatively wide neck, two narrow necks 110, 112 are provided at diagonally opposite corners of the liner 118 for inserting a material into or dispensing the material out of the drum 120. Each of the necks is provided with a corresponding top 114, 116. In this embodiment, the necks 110, 112 and tops 114, 116 extend above the liner top surface 122 with a corresponding change in the height of the shell body 124. Obviously numerous modifications may be made to this invention without departing from its scope as defined in the appended claims.

What is claimed is:

1. A drum for holding materials comprising: a blow-molded self supporting liner having liner sidewalls with a plurality of circumferential continuous groove means formed on said sidewalls for reinforcing said liner; and shell means surrounding said liner around a common longitudinal axis, said shell means having shell sidewalls, said liner sidewalls and shell sidewalls being curved around axes parallel to said longitudinal axis, and having relatively large sidewall radii of curvature in relation to a cross-sectional dimension of said shell.

2. The drum of claim 1 wherein said liner and shell means include liner and shell corner sections respectively interconnecting the corresponding liner and shell sidewalls respectively, said corner sections having corner radii smaller than said cross-sectional dimension.

3. The drum of claim 2 wherein said sidewalls and corner sections define a nominal square cross-section for said drum.

4. The drum of claim 1 wherein said line includes neck means for inserting material into said drum and cover means for covering said neck means.

5. A drum comprising:

a blow-molded liner having a cross-sectional dimension and including a bottom, a plurality of liner sidewalls extending upwardly from said bottom and having liner sidewall radii of curvature larger than said cross-sectional dimension, and an equal plurality of corner sections with liner corner radii of curvature, said liner corner radii being smaller than said cross-sectional dimension, said corner sections cooperating with said corner sidewalls to generate a liner nominal rectangular cross-sectional shape for said liner; and shell means surrounding said liner with said liner fitting snugly in said shell means, said shell means having a shell cross-sectional shape substantially identical to said liner cross-sectional shape.

6. The drum of claim 5 wherein said shell means includes a body section, and a top section in telescopic engagement with said body section.

7. The drum of claim 5 wherein said liner includes a top surface connected to said liner sidewalls and said corner sections, said top surface including a recess.

8. The drum of claim 7 wherein said liner further includes a neck disposed in said recess for inserting a material in said liner.

9. The drum of claim 8 further comprising a cover for covering said neck.

10. The drum of claim 9 wherein said cover is disposed within said recess.

11. The drum of claim 5 wherein said liner further includes a top surface and neck means disposed on said top surface.

12. The drum of claim 11 further comprising cover means for covering said neck means.

13. The drum of claim 12 wherein said neck means and cover means extend above said top surface beyond said sidewall means.

14. The drum of claim 13 wherein said body section is coextensive with said liner.

15. The drum of claim 5 wherein said shell is made of a fiber.

* * * * *